United States Patent [19]

Eide

[11] 4,045,654

[45] Aug. 30, 1977

[54] ELECTRIC HOTPLATE WITH THERMOSTAT

[75] Inventor: Svein Eide, Sandnes, Norway

[73] Assignee: A/S Ardal og Sunndal Verk, Oslo, Norway

[21] Appl. No.: 719,506

[22] Filed: Sept. 1, 1976

[30] Foreign Application Priority Data

Sept. 2, 1975 Norway ..... 752999

[51] Int. Cl.[2] ..... H05B 3/68

[52] U.S. Cl. ..... 219/449; 219/452; 219/456; 219/462; 219/530

[58] Field of Search ..... 219/446, 448, 449, 450, 219/452, 456, 462, 464, 530, 540

[56] References Cited

U.S. PATENT DOCUMENTS

| | | | |
|---|---|---|---|
| 2,644,874 | 7/1953 | Miller | 219/449 X |
| 2,689,903 | 9/1954 | Radley | 219/449 X |
| 2,691,717 | 10/1954 | Huck | 219/462 |
| 2,806,122 | 9/1957 | Thunander | 219/452 |
| 2,898,439 | 8/1959 | Wantz et al. | 219/450 |
| 3,739,149 | 6/1973 | Fischer et al. | 219/445 |
| 3,845,273 | 10/1974 | Hurko | 219/462 |
| 3,909,592 | 9/1975 | Eide | 219/462 |

FOREIGN PATENT DOCUMENTS

| | | | |
|---|---|---|---|
| 122,668 | 12/1971 | Norway | 219/449 |
| 128,976 | 5/1974 | Norway | 219/449 |

*Primary Examiner*—Volodymyr Y. Mayewsky
*Attorney, Agent, or Firm*—Wenderoth, Lind & Ponack

[57] ABSTRACT

An electric hotplate with a thermostat includes a heating plate which is joined to the surrounding cold zones by means of a bridge of relatively thin sheet metal. The actuating device for a thermostatic switch is operated by the vertical movement of the heating plate. This movement arises as a consequence of the horizontal expansions and contractions of the heating plate due to changes in temperature, such movements being converted, by means of the bridge, which acts as a hinge, to vertical movements.

9 Claims, 4 Drawing Figures

ELECTRIC HOTPLATE WITH THERMOSTAT

BACKGROUND OF THE INVENTION

This invention relates to an electric hotplate with a thermostat, in which the heating plate is joined to the surrounding cold or an zone by means of a bridge of relatively thin sheet metal.

U.S. Pat. No. 3,909,592 discloses a hotplate which consists of a continuous plate of metal, for example stainless steel, with one or several hot and cold zones brought about by the plate's being whole and continuous on the top side, but with the underside divided by unbroken grooves which surround the hot zones. The thin layer of stainless steel bridging the cold and hot zones will act as a circular hinge and convert the horizontal heat expansion of the heated zone to a vertical movement, resulting in a parallel displacement, in the same plane, of the heated zone. The present invention is based on this earlier design and exploits, in an advantageous manner, the possibilities which this has opened for achieving a simple, inexpensive and robust solution to the thermostatic control of electric hotplates.

Controlling the temperature of electric hotplates by means of thermostats or energy regulators is known in many different forms, which to a greater or lesser extent have certain failings and inadequacies.

Bi-metal thermostats are very sluggish, and this is a problem attached to all known mechanical systems for controlling the temperature of electric hotplates. This sluggishness of inertia can vary somewhat, but for most thermostatically controlled hotplates the difference between cut-in and cut-out will be around 30° - 50° C depending upon the type of thermostat, the positioning of the thermostat and the mass of the hotplate itself.

Electronic temperature control by means of thermistors or thermocouples is also known. It is further theoretically possible to build an electronically controlled system with a large number of thermocouples or thermistor probes distributed over the whole hotplate, but such a system would, on account of the cost, be of little practical interest. A further weakness of such a system would be that with the large number of components involved, the risk of failure would be correspondingly high.

Probably the most relevant known technique in connection with the present invention will be found in Norwegian Patent 122,668 which discloses the exploitation of the hotplate's horizontal heat expansion to operate a thermostatic switch. The movement of the hotplate is transmitted to the thermostatic switch by means of a rod, the ends of which are fixed to the underside of the plate, the rod extending across the plate. Contrary to the principle on which the present invention is based, this known construction is not based on the fact that the heating plate itself moves vertically as a function of its temperature.

For further elucidation of present art, reference is also made to U.S. Pat. No. 2,898,439 which describes a thermostat which can be used in connection with a hotplate. The upper part of this thermostat extends over the hotplate, and is pressed down to operate contacts when a saucepan or the like is placed on the hotplate. In other words, there is disposed a separate temperature probe for the thermostat.

SUMMARY OF THE INVENTION

The present invention relates to a hotplate thermostat system which aims at overcoming some of the weaknesses of earlier known systems for controlling the temperature of electric hotplates and the like.

The new and novel feature of an electric hotplate according to the invention consists primarily of the fact that the operating device for the thermostat switch is, in turn, operated by the vertical movement of the heating plate resulting from the horizontal expansions and contractions of the heating plate with changing temperature. A feature of this solution, in other words, is that a part of the thermostat serves as the heating plate, the vertical movements of which are used for the direct operation of a switching device dependent upon the temperature of the hotplate.

An arrangements of this nature has proved in practice to be highly sensitive to temperature changes, the difference between cut-in and cut-out of this system, contrary to other mechanical systems, being brought down into the range hitherto has been reserved for costly electronic systems, namely 3°- 4° C. That this has been possible can be partly explained by the relatively large movement which is available, namely 4 - 5 mm. A small linear expansion within any given region of the plate is thus converted to a larger vertical movement of the entire heating plate by means of a circular hinge connecting the heating plate to a surrounding cold or unheated zone.

Another advantage of the system according to the invention is that the power may be controlled so that it is not disconnected until the contents in a vessel placed on the heating place have reached boiling point. This requires a fairly correct positioning of the vessel. Because the hotplate itself acts as a thermostatic probe, the reaction time is short. An empty hotplate with only air cooling may be designed to, for example, cut out for 4 minutes and cut in for 12 seconds. If a cold saucepan is placed on a hotplate immediately after cut-out, it will cut in again after 2 seconds, and remain cut in until the contents have reached boiling point.

If the load (vessel) is placed off centre, the heating zone will not rise parallel with the cold zone, but will adopt an inclined position. There will nevertheless still be movement, so that also with an off-centre load, the temperature will be controlled. Substantially on the basis of this invention, the above-mentioned advantages are achieved through a very simple and cheap, yet robust, design and construction.

BRIEF DESCRIPTION OF THE DRAWINGS

The invention is described below in more detail with reference to the drawings, in which.

DETAILED DESCRIPTION OF THE INVENTION

Figure 1:
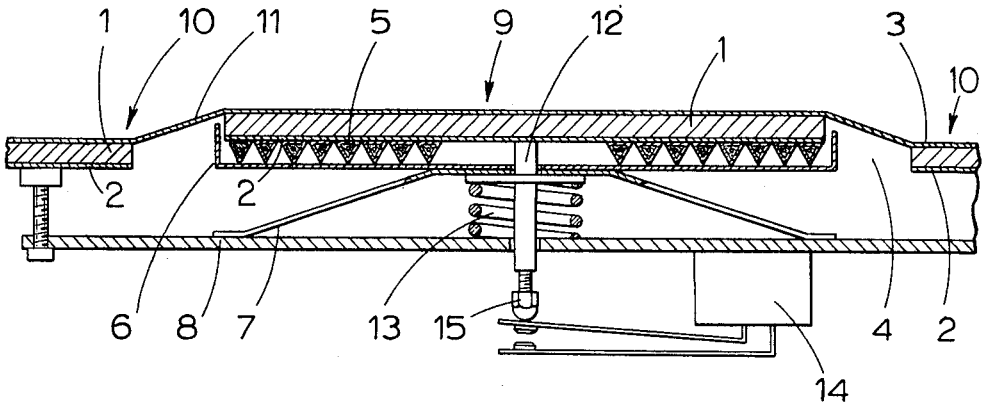
FIG. 1 is a schematic section through an electric hotplate with a thermostat according to an embodiment of this invention.

FIG. 1 depicts a plate 1 of aluminum or copper, clad on both sides with a thin layer 2, 3 of stainless steel. A heated zone or heating plate 9 is hinged to a surrounding cold or unheated zone 10 by a hinge 11 formed by a portion of layer 3. Heating of zone 9 will cause expansion of zone 9. This expansion is transformed into vertical movement of zone 9 with respect to zone 10. There is provided a heating element 5 for heating zone 9, element 5 being covered with a heat reflector 6 which is pressed upwards together with the heating element 5 by a spring 7 which in turn is held in position by a beam or plate 8.

A feature of the invention is that the spring 7 has a double function. It provides an elastic pressure which holds the reflector 6 and the heating element 5 pressed against the zone 9 which is to be heated up, i.e. the hotplate itself. At the same time spring 7 prevents the moving plate, or heating zone, 9 from moving downwardly when it is heated from the flat, cold, state to the hot or moved state. Plate 8 is fixed by its outer edges to the cold zone 10, and is thus kept stable, as shown schematically in FIG. 1. A portion of layer 3 between zones 9 and 10 forms a bridge 11 which acts as a hinge. The space in opening 4 between zones 9 and 10 acts as a temperature barrier which obstructs the condition of heat from zone 9 to cold zone 10. A length of steel rod 12 protrudes through a hole in plate 8 and is pressed up against the moving plate zone 9 by spring 13. The upward movement of plate 9 on being heated and the downward movement on cooling will thus be conveyed to steel rod 12, which in turn engages against a switch 14 and will cut the current as soon as the upward movement reaches the desired position. The temperature range can be regulated by adjusting the length of rod 12 by means of a nut 15.

Figure 2:
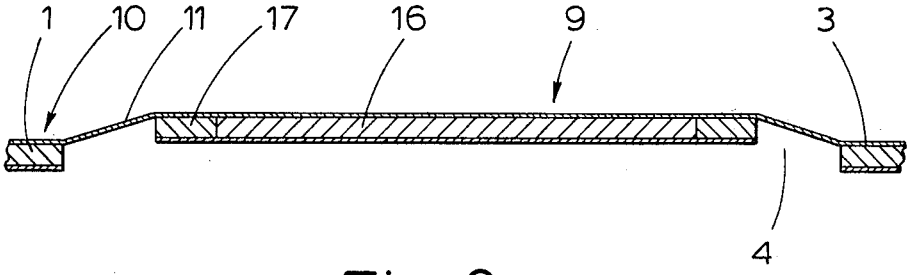
FIG. 2 is a section showing show a different design of the actual heating plate in FIG. 1, and FIGS. 3 and 4 are sections showing details of an expedient embodiment of the bridge, or intermediate piece, between the heating plate proper and the surrounding cold zone.

FIG. 2 depicts an embodiment in which the middle layer of the zone 9 consists of two different metals. A circular plate 16 of, for example, copper, is surrounded by a ring 17 of aluminuium. The coefficient of linear expansion of copper is $17 \times 10^{-6}$, whilst that of aluminium is $24 \times 10^{-6}$. As the temperature of zone 9 increases, the aluminium ring will expand more than the middle layer of copper, thus tensioning the zone 9, so that it remains flat during heating. It is very important that the zone 9 remains flat so as not to disturb the temperature setting. An embodiment as depicted in FIG. 1 requires that the zone 9 be made of thicker material than is the case with the embodiment shown in FIG. 2. Increasing the mass of the zone 9 increases the inertia of the combined system.

Figure 3:
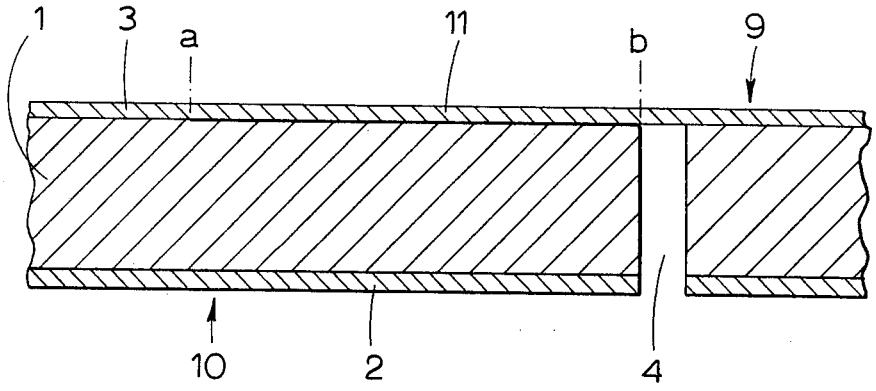
Figure 4:
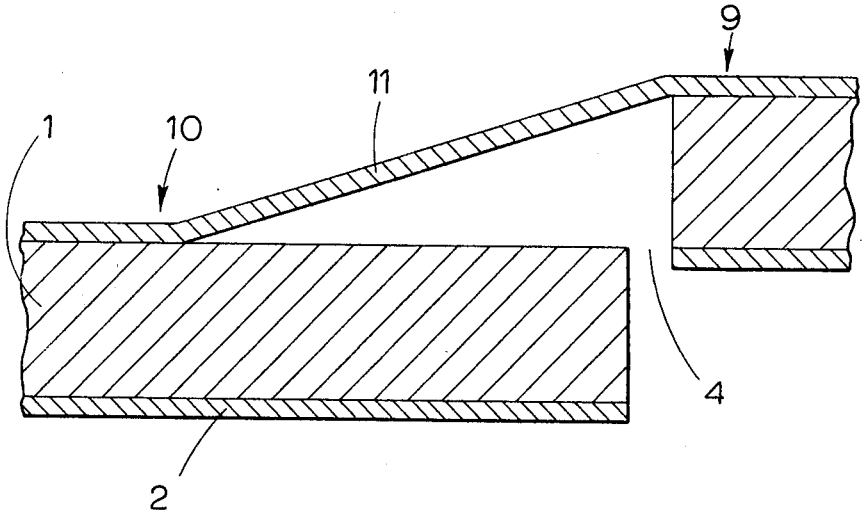

FIGS. 3 and 4 show an embodiment in which the opening 4 is partly closed in the cold state (FIG. 3). This provides a further assurance that the zone 9, starting from the flat position, can move only upwards. Further, this will also act as a safe-guard against too heavy a load, and protect the switch arrangement 14 against mechanical overloads.

The thin cladding sheet 3 of stainless steel or the like, is firmly bonded to the middle layer 1, except over length *a–b*. The opening 4 is made large enough to allow free movement of zone 9. On being heated, zone 9 will rise up as shown in FIG. 4, hinged about point a.

The electric hotplate according to this invention not only is well suited for ordinary household uses, but is also very advantageous for chip (pommes frites) and fondue pans and the like in professional kitchens.

I claim:

1. A thermostatically controlled electric hotplate comprising:

a horizontally aligned heating plate formed of thermally expandable material;

an unheated zone surrounding said heating plate;

electric heating element means, positioned beneath said heating plate, for, upon energization of said electric heating element means, heating said heating plate to cause horizontal expansion thereof, said heating plate being capable of horizontal contraction upon deenergization of said electric heating element means;

bridge means, formed of flexible sheet material connecting said heating plate with said unheated zone, for transforming said horizontal expansion into upward vertical movement of said heating plate relative to said unheated zone and for transforming said horizontal contraction into downward vertical movement of said heating plate relative to said unheated zone;

a switch electrically coupled to said electric heating element means, said switch having a closed position causing energization of said electric heating element means and an open position causing deenergization of said electric heating element means; and actuating member means, mechanically coupled to said heating plate and to said switch, for transmitting upward vertical movement of said heating plate to said switch to move said switch to said open position thereof and for transmitting downward vertical movement of said heating plate to said switch to move said switch to said closed position thereof.

2. A hotplate as claimed in claim 1, wheren said actuating member means comprises a vertically aligned rod urged upwardly into conrtact with said heating plate.

3. A hotplate as claimed in claim 1, wherein said heating plate and said unheated zone each comprise a laminate of three metal layers including a middle relatively thick layer having on opposite surface thereof relatively thin layers, the upper said relatively thin layer being continuous and extending over both said unheated zone and said heating plate, said bridge means comprising a portion of said upper layer extending between said heating plate and said unheated zone.

4. A hotplate as claimed in claim 3, wherein said upper layer is bonded to the middle layer of said unheated zone over the majority of the upper surface thereof, but is not bonded to said upper surface of said middle layer of said unheated zone over an area thereof adjacent said heating plate, whereby said bridge means includes the thus unbonded portion of said upper layer.

5. A hotplate as claimed in claim 3, wherein said middle layer comprises copper.

6. A hotplate as claimed in claim 3, wherein said middle layer comprises aluminum.

7. A hotplate as claimed in claim 3, wherein said relatively thin layers comprise stainless steel.

8. A hotplate as claimed in claim 1, wherein said heating plate is circular and comprises a laminate of three layers, the middle of which comprises a central circle of a first metal and a ring of a second metal surrounding said circle, said second metal having a larger coefficient of expansion than said first metal.

9. A hotplate as claimed in claim 1, further comprising a heat reflector positioned beneath said electric heating element means, and spring means for urging said reflector and said electric heating element means upwardly toward said heating plate.

* * * * *